United States Patent [19]

Kiritani et al.

[11] 4,178,215

[45] * Dec. 11, 1979

[54] METHOD OF MANUFACTURING BLAST FURNACE COKE

[75] Inventors: Yoshio Kiritani, Osaka; Michio Tsuyuguchi, Wakayama; Tetsuo Ibaragi, Wakayama; Katsuhiro Yano, Wakayama; Yoshihiko Sunami; Kunihiko Nishioka, both of Amagasaki, all of Japan

[73] Assignees: Sumitomo Metal Industries Limited, Osaka; Sumikin Coke Company Limited, Wakayama, both of Japan

[ * ] Notice: The portion of the term of this patent subsequent to Feb. 14, 1995, has been disclaimed.

[21] Appl. No.: 728,009

[22] Filed: Sep. 29, 1976

[30] Foreign Application Priority Data

Jun. 30, 1976 [JP] Japan ..... 51-78088

[51] Int. Cl.[2] ..... C10B 53/08; C10B 57/00; C10B 45/00

[52] U.S. Cl. ..... 201/6; 44/10 R; 44/10 H; 44/10 K; 44/23; 201/18; 201/21; 201/23; 201/41

[58] Field of Search ..... 201/6, 8, 21, 23, 18; 44/10 R, 10 G, 10 J, 10 K, 23

[56] References Cited

U.S. PATENT DOCUMENTS

| | | | |
|---|---|---|---|
| 2,808,370 | 10/1957 | Bowers | 201/23 X |
| 2,907,698 | 10/1959 | Schulz | 201/8 |
| 3,010,882 | 11/1961 | Barclay et al. | 201/6 UX |
| 3,316,155 | 4/1967 | Holowaty et al. | 201/6 |
| 3,444,047 | 5/1969 | Wilde | 201/6 |
| 3,619,376 | 11/1971 | Patel et al. | 201/23 |
| 3,623,999 | 11/1971 | Juntgen et al. | 201/8 |
| 3,637,464 | 1/1972 | Walsh et al. | 201/23 |
| 3,758,385 | 9/1973 | Fischer | 201/6 |
| 4,073,625 | 2/1978 | Kiritani et al. | 44/23 |

*Primary Examiner*—Michael S. Marcus

*Attorney, Agent, or Firm*—Watson, Cole, Grindle & Watson

[57] ABSTRACT

A method of manufacturing blast furnace coke wherein said coke is obtained by a process in which coal to be used for making briquettes is mixed with a caking substance having a softening point of 40°-250° C. with or without a solvent having fluidity at the mixing temperature and dissolvable to said caking substance, the resultant mixture being mixed by means of a powerful mixer capable of applying mixing energy of 0.01KW/Kg or more at a temperature of 40°-250° C. for 1-10 minutes, while a heating medium such as steam is passed therethrough and is then subjected to briquetting with a roll press. The briquette obtained is either carbonized directly or after blending with coal ready for coke oven charging.

15 Claims, 1 Drawing Figure

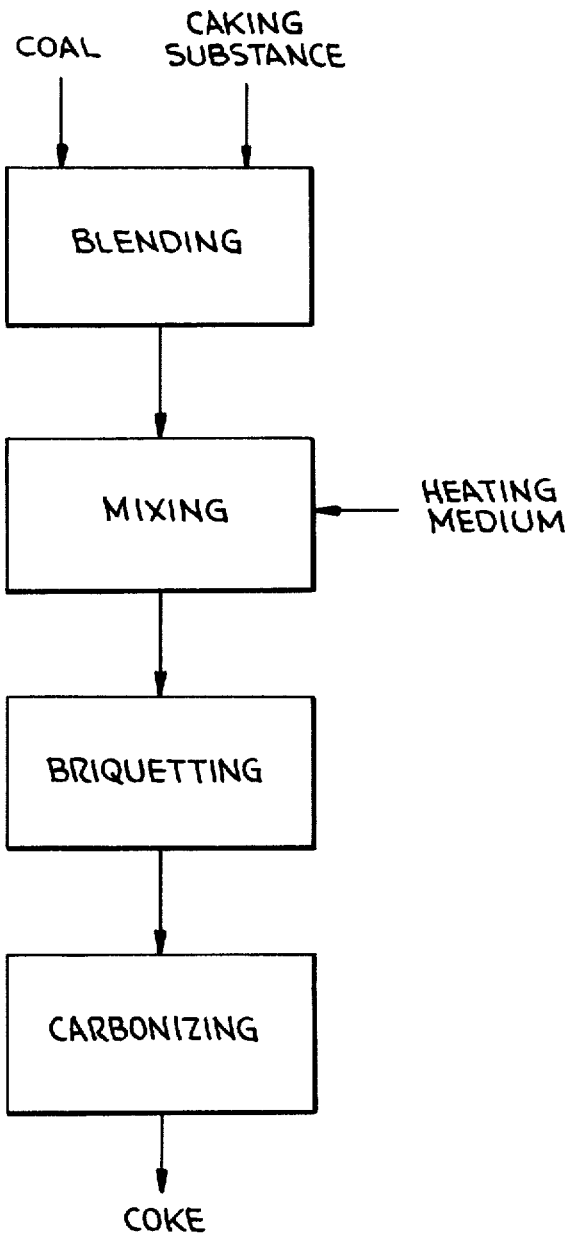
COAL
CAKING SUBSTANCE
BLENDING
MIXING
HEATING MEDIUM
BRIQUETTING
CARBONIZING
COKE

METHOD OF MANUFACTURING BLAST FURNACE COKE

BACKGROUND OF THE INVENTION

1. Field of the Invention

The present invention relates to a method of manufacturing blast furnace coke using briquette which is one of the coke manufacturing techniques.

2. Description of the Prior Art

With recent developments in the field of iron and steel industry, the demands for the principal raw materials such as coke are rapidly increasing. Thus, it has become more and more difficult to obtain hard coking coal of high quality essential to the manufacture of blast furnace coke due to the universal restriction of resources and high costs.

The fact has given the priority to the research and development of a method for manufacturing blast furnace coke of high quality using a blend of coal of relatively low grade such as non coking or poorly coking coal. These coals have so far been considered unfit for the manufacture of blast furnace coke. In addition, blends of larger amounts of soft coking coal and various caking substance or manufacturing methods using such substances have been proposed.

A method of manufacturing coke by obtaining briquettes, blending it in the portion of coal ready for coke oven charging and carbonizing the blend has been proposed for a possible solution of the above problem. The prior art methods of manufacturing briquettes use a caking substance of bituminous material with a softening point at around 60° to 80° C. The blend is mixed with a mixer such as a pug mill, i.e., a low speed rotating type mixer having a mixing tool with the peripheral speed at 5.0 m/sec or lower, while steam at 120° to 250° C. is being blown into the blend, and is then briquetted. Important factors involved in these methods are the adjustment of the softening point of the caking substance, the temperature of the blown steam and mixing duration. A mixing duration of around 4 to 10 minutes is employed for the industrial scale due to various restrictions. Accordingly, to maintain the strength of the briquette, a caking substance having a suitable softening point corresponding to the temperature of the steam must be selected and a great amount of steam must be applied. In practice, however, when a low speed rotating type mixer such as a pug mill is used, even if the softening point of the caking substance and the steam consumption are well adjusted, the mixture immediately before briquetting will not be mixed to a satisfactory uniformity. This is evident from the fact that the inventors of the present invention noted in their experiments wherein tar sludge produced in the coke manufacturing process is used as raw material for briquetting, scattering in the quality of briquette when the mixing duration was shorter than a certain period, i.e., 5 minutes or preferably longer than 7 minutes, with a double shaft, one stage pug mill, while the quality of briquette mixed for the above duration was found to be stable.

Therefore, to obtain a throughly uniform mixture by the use of a low speed rotating type mixer with low mixing efficiency such as pug mill, it is preferable to utilize as long mixing duration as possible. The method, therefore, requires a mixer and, accordingly, a steam generator large in size. Consequently, the costs for the plant construction are increased and the plant may be subjected to various severe restrictions for pollution control.

SUMMARY OF THE INVENTION

The inventors of the present invention have disclosed in Japanese Patent Application No. 137567/75 an improvement in the conventional method for making briquettes which requires heating, wherein the briquettes can be obtained by mixing and briquetting at a normal temperature. As a result of further research, a improved manufacturing method of blast furnace coke of high quality has been developed. The method involves the use of briquettes with higher strength than that which is produced in the industrial scale.

Accordingly, an object of the present invention is to provide a method of manufacturing coke comprising blending of a caking substance with coal for the coke production, mixing the blend with a powerful mixer while heating into a thoroughly uniform mixture, processing the blend into briquette and then carbonizing the briquette thus obtained into the final product.

The coke manufacturing method according to the present invention will now be described in greater detail. The coal to be used for making briquette is blended with a caking substance with the softening point of 40° to 250° C., mixed by a powerful mixer capable of applying mixing energy of 0.01 KW/Kg or more for a duration of one to 10 minutes, preferably for 2 to 5 minutes, at the temperature of 40° to 250° C. while passing a heating medium such as steam or the like through the blend, and briquetted into briquette with a roll press. The briquettes then thus obtained is carbonized directly or after blended with coal ready for coke oven charging for the final product. The process includes a conveying means intervening the proceses shown above and associated processes.

Other features according to the present invention are the use of a variety of bituminous substances with the softening point of 40° C. or above as the caking substance together with a solvent dissolvable in said caking substance and having fluidity at the mixing temperature, using a heating temperature lower than the softening point of said caking substance during the powerful mixing, briquetting after a uniform mixture is obtained from said powerful mixing, and carbonizing the briquette thus obtained for the final product.

According to the present invention, not only may a variety of bituminous substances with a softening point of 40° C. or higher be used as the caking substance but the mixing process may be operated at a temperature lower than the softening point of said caking substance. The consumption of steam, if used, may be much smaller than when a pug mill or the like is used. Conventional briquette manufacturing technique is one in which a low speed rotating type mixer of poor mixing efficiency is used, steam of a temperature higher than the softening point of the caking substance is introduced to plasticize the caking substance, the plasticized caking substance is spread over the coal particle surface to thereby cover the surface and the mixture thus obtained is briquetted. While, in the method according to the present invention, the caking substance with a softening point of 40° C. or higher is heated by a heating medium so as to have the plasticity suitable to and facilitating the operation, and the caking substance is extended while caking substance and coal particles are mixed with the strong mechanical force into a thoroughly uniform mixture, hence causing the surface of coal particle to be covered with the extended caking substance. In the structure where a solvent is also used at the time of mixing, since caking substance particles are dissolved and extended over the surface of the coal particles by the combined action of a strong mechanical force and the solvent, even when the mixing is performed at a much lower temperature than the softening point of the caking substance, the caking substance will cover the coal particle surface in sufficient uniformity.

In comparison to when a pug mill or the like is used as in conventional practice, when a powerful mixer is provided, steam consumption for heating, if any, at the time of mixing will be small with the resultant advantage of a smaller steam generator. As will be shown in the examples, the mixing duration can be thereby making possible a smaller plant size for an advantage in terms of pollution control and economy.

BRIEF DESCRIPTION OF THE DRAWING

The sole FIGURE of the drawing illustrates the steps of the method of the present invention in a flow type chart.

DETAILED DESCRIPTION OF THE INVENTION

According to the present invention, coal tar pitch, asphalt or pitch obtained by the heat treatment or solvent extraction of coal tar pitch, asphalt, petroleum base residual oil or the like may be used as a caking substances having the softening point of 40° C. to 250° C. The above caking substances added with coal tar, road tar, propane deasphalting asphalt or the like may also be used. In this situation, a blending ratio within the range of 4 to 15 weight percent is considered suitable for such briquette process, taking into account the briquette and coke strength, briquettability, etc.

For the actual application of the method of the present invention, a powerful mixer is used in lieu of a conventional low speed rotating type mixer. For particles in which coal particles, caking substance or the like are mixed, it is preferable to use a high speed rotating type mixer capable of mixing with a mixing tool (including auxiliary mixing tool) rotating at a high peripheral speed of 5 m/sec or faster and/or a increasing pressure type mixer capable of mixing while applying the pressure of 45 $Kg/cm^2$ or more.

For example, a high speed rotating type mixer for this purpose includes the Eirich type mixer equipped with a rotary pan containing raw material and a plurality of high speed rotary mixing tools which is capable of mixing at the relative speed between particles being mixed or between the particles being mixed and mixing tools at a high peripheral speed above 5 m/sec to thereby result in the application of a strong impact force. The energy requirement in energy applied per unit weight of material to be mixed in mixing is approximately 0.05 to 0.3 KW/Kg. The increasing pressure type mixer includes the Muller type mixer in which the weight of a rotary muller wheel may be adjusted by the use of a spring, etc. thereby allowing the optional selection of compressive force within a certain range so that the compression pressure of the muller wheel becomes 10 to 22 kg or 2260 to 3500 kg according to the type of the mixer. This type of mixer is also capable of mixing the particles while kneading, smearing and spatulating at the same time under the pressure of muller wheel, the energy requirement of which is around 0.02 to 0.13 KW/Kg.

The solvent dissolvable in the caking substance includes coal tar, propane deasphating asphalt, etc. or the caking substance blended with road tar, asphalt, coal tar or the like depending on the mixing temperature for the adjustment of fluidity. The blending ratio may be selected optionally to be within the range of 3 to 15 weight percent which is considered suitable for such briquette preparation taking into account the briquettability of briquette.

For the coal to be used for making the briquettes, more than 25% of non and/or poorly coking coal may be blended with less than 75% of a hard, semi hard and/or soft coking coal in an optional ratio and the coals will be blended so that the strength of briquette obtained when the briquette is prepared by the addition of the caking substance, etc. becomes more than 80 in the shatter strength (ASTM D141 falling strength test) and more than 90 in the trommel strength (JNR trommel test). It is preferable to increase the blending ratio of non and/or poorly coking coal by the use of techniques to blend briquettes of various shapes to further improve the economical effects.

For the coal to manufacture the formed coke, more than 60% of non and/or poorly coking coal will be blended with less than 40% of a hard, semi hard and/or soft coking coal in an optional ratio. When the caking substance or the like is blended to prepare the briquette, it will be blended so that the strength of the briquette thus obtained becomes more than 80 in shatter strength, more than 90 in trommel strength and more than 50 in crashing strength (when the force at the point where the briquette crushes is measured in the test with a compression testing machine using 20 sample briquettes, the mean strength of the samples except ones indicating abnormal value is represented in kg/unit). In the determination thereof, proximate analysis, FSI, etc. of said coals should be taken into consideration.

Coal to manufacture for coke defined in the present invention involves the above mentioned coal to be used for making briquettes and coal to manufacture the formed coke.

The briquette prepared from the coal to be used for making briquettes blend with coal ready for coke oven charging which should contain 25 to 30% of volatile matters and should be within 3 to 8 FSI (ASTM D720 Fluidity Swelling Test). It should be blended in the range of 5 to 85% with the coal ready for coke oven charging and carbonized, the drum strength becomes above $DI_{15}^{30}$ 92 and above $DI_{15}^{150}$ 80. The briquettes prepared from the coal to manfacture the formed coke may be carbonized directly so that its drum strength become above $DI_{15}^{30}$ 92 and above $DI_{15}^{150}$ 80 also. As mentioned above, only when the briquettes of the shape are blended, as decrease of the coke strength due to segregation, etc. of briquette in the coal ready for coke oven charging is noted and the blending ratio of briquette must usually be around 30%. As disclosed by the inventors of the present invention in Japanese Patent Application No. 5023/76, when more than one kind of briquette of the different shape are prepared and blended, the blending ratio of briquette may be increased up to around 85%. In either case, formed coke will be obtained by the direct carbonization of briquette or coke is obtained by partially blending with said coal ready for coke oven charging and then carbonizing.

The present invention will now be described with reference to the appended examples below.

EXAMPLE 1

The coals shown in Table 1 blended for making the briquette and 8% of coal tar pitch having the softening point of 65° C. are placed in an Eirich type mixer, a Muller type mixer and pug mill, respectively, and then mixed at a temperature of 75° to 80° C. while steam is being passed. Thereupon, Mashek type briquettes (32 mm×32 mm×18 mm) are prepared with a roll press and then the shatter, trommel and crashing strength of the briquettes obtained are measured. The result and mixing duration are shown in Table 2. The grading of coals is formulated prior to the blending of the caking so as to have 84% of under 3 mm square screen and 8% total moisture.

Table 1

| Coals | Proximate analysis (%) Inherent moisture | Ash | Volatile matters | FSI ASTM D720) | Blending ratio % |
|---|---|---|---|---|---|
| US hard coking coal | 1.2 | 6.9 | 19.8 | 9 | 4 |
| Australia hard coking coal | 1.3 | 9.1 | 21.1 | 8½ | 5 |
| Canada hard coking coal | 1.1 | 9.5 | 20.4 | 7 | 10 |
| US semihard coking coal | 1.6 | 7.6 | 27.6 | 7½ | 9 |
| Australia semi hard coking coal | 2.1 | 7.8 | 27.3 | 3½ | 11 |
| Australia soft coking coal | 3.7 | 8.7 | 35.5 | 3½ | 5 |
| Japan soft coking coal | 2.3 | 8.9 | 89.0 | 4 | 6 |
| Non and poorly coking coal | 3.3 | 12.7 | 34.2 | 1 | 50 |

Table 2

| Test No. | 1 | 2 | 3 | 4 | 5 | 6 | 7 |
|---|---|---|---|---|---|---|---|
| Eirich type mixing* | 0 | 0 | | | | | |
| Muller type mixing* | | | 0 | 0 | | | |
| Pug mill mixing* | | | | | 0 | 0 | 0 |
| Mixing time, (min.) | 1 | 3 | 2 | 5 | 3 | 10 | .15 |
| Shatter strength | 88.8 | 92.5 | 82.8 | 91.0 | 70.3 | 86.2 | 91.5 |
| Trommel strength | 92.0 | 94.5 | 90.9 | 94.2 | 84.0 | 91.7 | 92.8 |
| Crashing strength, (kg/unit) | 57 | 70 | 50 | 65 | under 30 | 54 | 66 |
| Remarks | According to the present invention | | | | Comparison | | |

*Mixing conditions

| Item | Peripheral speed or compressive force of mixing tool | Charging weight (kg) | Power applied (KW) | Energy requirement, (KW/Kg) |
|---|---|---|---|---|
| Eirich type mixing | Peripheral speed 20m/sec | 35 | 8.8 | 0.251 |
| Muller type mixing | Compressive force 60kg/cm$^2$ | 35 | 1.1 | 0.031 |
| Pug mill mixing | Peripheral speed 2.5 m/sec. | 30 | 0.4 | 0.0133 |

As shown in Table 2, the result of Eirich type mixing and Muller type mixing according to the present invention indicates a shatter strength of above 80, a trommel strength of above 90 and a crashing strength of above 50 kg/unit and that briquettes sufficiently useful on an industrial scale are easily obtained by mixing for a short period such as one to 5 minutes. While in a conventional pug mill, a mixing period of 10 to 15 minutes is required for mixing (Test No. 6 or 7), a one to 3 minute mixing by the Eirich type, mixer and a 2 to 5 mixing by the Muller type mixer give almost equal or even higher strength. Although it is preferable to utilize a longer mixing time since a tendency is noted that the longer the mixing time, the higher the strength of briquette, it is desirable to keep the mixing time within 10 minutes in consideration of various restrictions associated with the application on an industrial scale. Accordingly, the present invention which involves a powerful mixing such as Eirich or Muller type mixing requires only a small area for the equipment if the mixer is installed and the steam consumption necessary to maintain the mixing temperature is small. The necessity to provide a multi-stage plant and a large sized steam generator to maintain each piece of equipment at the proper mixing temperature as in case of pug mill mixing is eliminated.

A hard briquette with a crashing strength above 50 kg/unit greatly facilitates handling relative to transportation, etc., after briquette preparation. Special considerations such as placing a portion of coal ready for coke oven charging on the conveyor for transportation as in case of handling soft briquette are not required.

The present invention also involves Eirich or Muller type mixing as the powerful mixing and the case where an Eirich type mixer or a Muller type mixer is independently employed. However, these mixers may be used in parallel or in combination, and then better result may be obtained under some conditions.

EXAMPLE 2

Coals shown in Table 3 which are blended for manufacturing formed coke are blended with 6% of a caking substance having the softening point of 196° C. obtained by the heat treatment of petroleum base residual oil. The blend is charged into an Eirich type mixer, a Muller type mixer and pug mill, respectively. Then, 5% of a mixed solvent which is obtained by mixing one part of road tar having a softening point of 30° C. with 0.5 part of coal tar is added. The mixture is mixed at a temperature of 79° to 81° C. while passing steam. A Mashek type briquette (65 mm×65 mm×45 mm) is immediately prepared with a roll press and the shatter, trommel and crashing strength the resultant briquette are measured. The results obtained and mixing time are shown in Table 4. The grading of coals is prepared before blending so as to have 95% of under 3 mm square screen and 6% total moisture.

Table 3

| Coals | Proximate analysis, (%) Inherent moisture | Ash | Volatile matters | FST (ASTM D720) | Blending ratio (%) |
|---|---|---|---|---|---|
| South Africa anthracite | 3.2 | 11.0 | 10.5 | — | 10 |
| Petroleum coke | 1.2 | 0.5 | 13.2 | — | 20 |
| Canada non coking coal | 4.5 | 12.8 | 20.5 | ½ | 15 |
| South Africa poorly coking coal | 2.8 | 6.5 | 31.2 | 1 | 40 |
| Australia semi-hard coking coal | 2.2 | 9.2 | 27.7 | 4 | 15 |

Table 4

| Test No. | 8 | 9 | 10 | 11 | 12 | 13 | 14 |
|---|---|---|---|---|---|---|---|
| Eirich type | 0 | 0 | | | | | |

Table 4-continued

| Test No. | 8 | 9 | 10 | 11 | 12 | 13 | 14 |
|---|---|---|---|---|---|---|---|
| mixing* | | | | | | | |
| Muller type mixing* | | | 0 | 0 | | | |
| Pug mill mixing* | | | | | 0 | 0 | 0 |
| Mixing time, (min) | 1 | 3 | 2 | 5 | 3 | 10 | 15 |
| Shatter strength | 90.1 | 93.8 | 85.6 | 91.2 | 73.4 | 79.1 | 88.9 |
| Trommel strength | 93.5 | 94.3 | 91.3 | 93.7 | 79.7 | 85.7 | 91.5 |
| Crashing strength (Kg/unit) | 151 | 176 | 140 | 169 | 45 | 66 | 149 |
| Remarks | According to the present invention | | | | Comparison | | |

*Mixing conditions are the same as those of Example 1.

As shown in Table 4, briquettes sufficiently applicable to industrial use having a shatter strength of above 90, a trommel strength above 90 and a crashing strength of above 140 are easily obtained.

The effects of using a solvent in conjunction with powerful mixing according to the present invention is to give a very high strength briquette notwithstanding the fact that the mixing is performed at approximately 80° C., which is lower than the softening point of the caking substance. While in conventional pug mill mixing, even the extended 10 minute mixing in Test No. 13 gives a crashing strength of about 60 kg/unit. Accordingly, it might be reasonable to say that the present invention which involves powerful mixing provides sufficiently uniform mixing and greatly improved briquette strength as a result of interaction among coal particles, the caking substance and the solvent due to powerful mixing energy applied.

EXAMPLE 3

Coals shown in Table 1 are blended with caking substances having different softening point, mixed and then charged into an Eirich type mixer and pug mill, respectively. When a caking substance having a softening point of 90° or higher is used, coal tar, road tar or a mixed solvent containing one part of road tar and 0.5 part of coal tar as much as 5% is added and mixed while passing steam. Subsequently briquettes as shown in Example 1 are prepared and the strength is measured. For mixing, an Eirich type mixer equipped with a mixing tool having a peripheral speed of 25 m/sec is used to perform a 3 minute mixing and a pug mill equipped with a screw having a peripheral speed of 2 m/sec is used to perform a 10 minute mixing. The results obtained, the softening point of the caking substance, the kind of solvent and mixing temperature are shown in Table 5.

Table 5

| Test No. | 15 | 16 | 17 | 18 | 19 | 20 | 21 |
|---|---|---|---|---|---|---|---|
| Softening point of coking agent, (°C.) | 43 | 98 | 126 | 168 | 250 | 98 | 250 |
| Kind of solvent | None | Coal tar | Coal tar | Coal tar, road tar | Road tar | Coal tar | Road tar |
| Type of mixer | Eirich type mixer | | | | | Pug mill | |
| Mixing temp. (°C.0) | 50 | 60 | 60 | 75 | 90 | 60 | 90 |
| Shatter strength | 91.7 | 92.6 | 91.8 | 89.4 | 88.4 | 45.3 | 12.4 |
| Trommel strength | 94.0 | 93.9 | 94.5 | 91.0 | 92.1 | 71.3 | 26.0 |
| Remarks | According to the present invention | | | | Comparison | | |

As is shown in Table 5, a powerful mixing in accordance with the present invention makes possible the production of industrially feasible briquette having a shatter strength over 80 and a trommel strength over 90.

In contrast, with conventional pug mill mixing, as shown by the results of Test Nos. 20 and 21, the briquette strength is very low and is not industrially feasible. This is due to the improper caking substance, solvent, mixing temperature and mixer used. As might be readily seen from Test Nos. 16 and 19, which utilize the same conditions of Test Nos. 20 and 21, the powerful mixing may be performed at the temperature lower than the softening point of the caking substance with the resultant advantages of smaller plant size and lowered costs.

As the caking substance, a variety of bituminous substances with a softening point of 40° to 250° C. may be used.

Not only may the mixing temperature be lower than the softening point of the caking substance but in addition, a higher temperature than the softening point may be used for mixing. Accordingly, the mixing temperature may be selected optionally within the temperature range with the upper limit of around 250° C. which is the maximum temperature for a conventional pug mill mixing thereby contributing to easy and simple operation and uniform quality of the briquettes produced.

EXAMPLE 4

Coals shown in Table 1 are blended with 6% of a caking substance with the softening point of 140° C. obtained by the heat treatment of petroleum base residual oil, charged into an Eirich type mixer and a Muller type mixer, 7% of coal tar heated to 50° C. as a solvent is added, and then the mixture mixed at the temperature of 69° to 71° C. while passing steam therethrough. Immediately thereafter, briquettes are prepared in the same manner as in Example 1 and the strength measured. Since the purpose of this example is to test either the relative speed between particles being mixed and the mixing tool or the force of pressure applied, the speed of revolution of the mixing tool for the Eirich type mixer and the spring of the muller wheel for the Muller type mixer are adjusted to obtain various conditions. The results obtained and mixing time are shown in Table 6 for the Eirich type mixing and in Table 7 for the Muller type mixing.

Table 6

| Test No. | 22 | 23 | 24 | 25 |
|---|---|---|---|---|
| Relative speed, (m/sec) | 5 | 10 | 20 | 25 |
| Mixing time, (min) | 3 | 3 | 3 | 3 |
| Shatter strength | 88.3 | 94.5 | 98.3 | 97.4 |
| Trommel strength | 90.3 | 92.3 | 95.1 | 95.4 |

Table 7

| Test No. | 26 | 27 | 28 | 29 |
|---|---|---|---|---|
| Applied pressure, (kg/cm$^2$) | 35 | 45 | 60 | 100 |
| Mixing time, (min) | 4 | 4 | 4 | 4 |
| Shatter strength | 81.4 | 90.6 | 91.8 | 93.0 |
| Trommel strength | 89.8 | 91.2 | 93.0 | 94.2 |

As is shown in Tables 6 and 7, satisfactory briquettes can be obtained by using an Eirich type mixer equipped with a mixing tool having a peripheral speed above 5 m/sec or a Muller type mixer equipped with a muller wheel having a pressure above 45 kg/cm$^2$. When the peripheral speed of the mixing tool of the Eirich type mixer is below 5 m/sec, the briquette strength may not be sufficient.

EXAMPLE 5

Briquettes of Test Nos. 2, 3 and 7 in Example 1 and Test Nos. 16, 19, 20 and 21 of Example 3 are blended with coal ready for coke oven charging as shown in Table 8 and are then carbonized according to JIS M 8801 5.3 box test procedures. The drum strength of the coke obtained and the blending ratio of briquette are shown in Table 9.

Table 8

| Coals | Proximate Analysis (%) Inherent moisture | Ash | Volatile matters | FSI (ASTM D720) | Blending ratio (%) |
|---|---|---|---|---|---|
| US hard coking coal | 1.2 | 6.9 | 19.8 | 9 | 8 |
| Australia hard coking coal | 1.3 | 9.1 | 21.1 | 8½ | 10 |
| Canada hard coking coal | 1.1 | 9.5 | 20.4 | 7 | 20 |
| US semi hard coking coal | 1.6 | 7.6 | 27.6 | 7½ | 18 |
| Australia semi coking coal | 2.1 | 7.8 | 27.3 | 3½ | 22 |
| Australia soft coking coal | 8.7 | 8.7 | 35.5 | 3½ | 10 |
| Japan soft coking coal | 2.3 | 8.9 | 39.0 | 4 | 12 |

Table 9

| Test No. | | 2 | 3 | 16 | 19 | 7 | 20 | 21 | Coal ready for coke oven charging |
|---|---|---|---|---|---|---|---|---|---|
| Blending ratio of briquette (%) | | 45 | 20 | 30 | 10 | 30 | 30 | 10 | 0 |
| Drum strength | $DI_{15}^{30}$ | 93.0 | 92.8 | 93.6 | 93.0 | 93.1 | 92.6 | 91.3 | 92.8 |
| | $DI_{15}^{150}$ | 83.1 | 82.9 | 83.7 | 83.0 | 83.0 | 82.6 | 77.2 | 81.4 |
| Remarks | | According to the present invention | | | | | | Comparison | |

As is shown in Table 9, the coke obtained according to the present invention possesses a high strength of above $DI_{15}^{30}$ 92 and above $DI_{15}^{150}$ 82 even though a large amount of non and/or poorly coking coal is blended at the step of briquette preparation and the coke is evidently feasible for the practical application as a blast furnace coke. In this Example 5, where blending briquette of identical shape is exemplified and the blending ratio of briquette of up to 45% is examined. The blending ratio of briquette can be increased up to around 85% when briquettes of different shapes are prepared according to the techniques disclosed by the inventors of the present invention in Japanese Patent Application No. 50230/76 and said briquettes of different shapes can be blended.

EXAMPLE 6

The briquettes of Test Nos. 8, 9, 10, 11 and 14 in Example 2 are directly carbonized according to JIS M 8801 5.8 box test procedures and then the drum and crashing strength of the resultant formed coke is measured. The results obtained are shown in Table 10.

Table 10

| Test No. | | 8 | 9 | 10 | 11 | 14 |
|---|---|---|---|---|---|---|
| Drum strength | $DI_{15}^{30}$ | 95.3 | 97.0 | 94.0 | 96.2 | 94.3 |
| | $DI_{15}^{150}$ | 85.3 | 87.1 | 84.2 | 86.5 | 85.1 |
| Crashing strength, (kg/unit) | | 432 | 489 | 421 | 453 | 423 |
| Remarks | | This invention | | | | Comparison |

As is shown in Table 10, the formed coke obtained according to the method of the present invention possesses a strength of above 94 in $DI_{15}^{30}$, above 84 in $DI_{15}^{150}$ and above 420 kg/unit of crashing strength which thereby makes the formed coke sufficiently feasible for practical application.

EXAMPLE 7

Coal for the manufacturing of formed coke as shown in Table 11 blended with 7% of coal tar pitch having a softening point of 82° C. is charged into an Eirich type mixer, 3% of coal tar heated to 50° C. as a solvent is added and is then mixed at a temperature of 85° to 90° C. while passing steam. Immediately thereafter, Mashek type briquette (55 mm×55 mm×35 mm) are prepared with a roll press and the shatter, trommel and crashing strength of a portion of resultant briquette are measured. Thereafter, the remaining briquette is carbonized according to JIS M 8801 5.3 box test procedures. The drum strength and crashing strength of the formed coke thus obtained are shown in Table 12.

Table 11

| Coals | Proximate analysis (%) Inherlent moisture | Ash | Volatile matters | FSI (ASTM D720) | Blending ratio (%) |
|---|---|---|---|---|---|
| South Africa non coking coal | 4.0 | 8.8 | 24.3 | — | 25 |
| South Africa poorly coking coal | 3.8 | 9.2 | 29.5 | ½ | 35 |
| Australia semi hard coking coal | 2.2 | 9.2 | 27.2 | 3½ | 40 |

Table 12

| Briquette strength | | Coke strength | | |
|---|---|---|---|---|
| Shatter strength | 90.8 | Drum | $DI_{15}^{30}$ | 93.8 |
| Trommel strength | 94.7 | strength | $DI_{15}^{150}$ | 77.3 |
| Crashing strength (kg/unit) | 153 | Crashing strength (kg/unit) | | 200 |

As is shown in Table 12, formed coke sufficiently usable as blast furnace coke is easily obtained by the use of coals for manufacturing formed coke composed of the mixture of 60% of non and/or poorly coking coal and 40% of soft, semi hard and/or hard coking coal.

As mentioned above, a powerful mixing as Eirich type or Muller type mixing according to the present invention can be effected while heating in the course of the manufacturing process for blast furnace coke. If required, a sufficiently uniform mixing before briquetting can be made for a short time by a synergistic action with an added solvent so that the strength of the resultant briquettes can be increased thereby causing the operation to be easy and simple and the quality of the briquettes obtained can be stabilized. Accordingly, a plant to be installed for the implementation of the present invention is economical since no large sized steam generator for heating medium is required. Even when a great amount of non and/or poorly coking coal is blended as coals, the high strength of the coke obtained makes it sufficiently usable as a blast furnace coke and thus helps to reduce the recent world resources situation.

What is claimed is:

1. A method of manufacturing blast furnace coke comprising the steps of blending coals used for the production of coke with a caking substance to yield a mixture, powerfully mixing the mixture obtained for a time of one to five minutes with a mixer capable of applying mixing energy of more than 0.02 KW/kg while passing a heating medium through the mixture, briquetting the mixture obtained in said mixing step and producing coke by carbonizing the briquette obtained.

2. The method as defined in claim 1 wherein the softening point of said caking substance is from 40° to 250° C. and the mixing temperature is selected from the range of 40° to 250° C.

3. The method as defined in claim 1 wherein the time of mixing is selected from the range of 2 to 5 minutes.

4. The method as defined in claim 1 wherein the mixing is performed by a high speed rotating type mixing tool, the peripheral speed and energy requirement of said mixing tool being above 5 m/sec and 0.05 to 0.3 KW/kg respectively, the mixture being mixed for one to three minutes.

5. The method as defined in claim 1 wherein the mixing is performed by a mixing tool rotating so as to apply pressure, the applying pressure and energy requirement of said mixing tool being above 45 kg/cm$^2$ snf 0.02 to 0.13 KW/kg respectively and kneading, smearing and spaturating motions are applied by the tool, the mixture being mixed for a time of five minutes.

6. The method as defined in claim 1 wherein said coals to be used for making briquettes are those that include more than 25% of coking coal in the group ranging from non-coking to poorly-coking coal and less than 75% of coking coal in the group ranging from hard coking coal to soft coking coal and said briquette obtained is blended with coal ready for coke oven charging within the range of 5 to 85% before carbonizing.

7. The method as defined in claim 1 wherein said coals to manufacture the formed coke are those that include more than 60% of coking coal in the group ranging from non-coking coal to poorly-coking coal and less than 40% of coal in the group ranging from hard coking coal to soft coking coal and only said briquette obtained is carbonized.

8. The method as defined in claim 1 wherein the blending ratio of said caking substance is selected from the range of 4 to 15% by weight.

9. The method as defined in claim 1 wherein the mixture obtained in the blending step is blended with a solvent.

10. The method as defined in claim 9 wherein said solvent blended in the mixture possesses fluidity at the mixing temperature and the ability to dissolve in said caking substance.

11. The method as defined in claim 9 wherein the mixing is performed at a temperature lower than the softening point of said caking substance.

12. The method as defined in claim 9 wherein the blending ratio of said solvent is selected from the range of 3 to 15% by weight.

13. A method of manufacturing blast furnace coke comprising the steps of blending coals used for coke production with a caking substance having a softening point of 40° to 250° C., powerfully mixing at a temperature of 40° to 250° C. for one to five minutes with a mixer capable of applying a mixing energy of more than 0.02 KW/kg while passing a heating medium through the mixture, briquetting the mixture obtained from mixing with a roll press and carbonizing the briquettes obtained.

14. The method as defined in claim 13 wherein said briquettes are blended with coal ready for coke oven charging before carbonizing.

15. The method as defined in claim 13 wherein the coals and caking substance are blended with a solvent having fluidity at the mixing temperature and being mutually dissolvable with said caking substance and the heating temperature at the time of mixing is maintained lower than the softening point of said caking substance.

* * * * *